US011707119B2

(12) United States Patent
Boucard et al.

(10) Patent No.: US 11,707,119 B2
(45) Date of Patent: Jul. 25, 2023

(54) ARTICULATED BRACELET WITH HIDDEN ARTICULATIONS

(71) Applicant: Comadur SA, Le Locle (CH)

(72) Inventors: Sylvain Boucard, Villers-le-Lac (FR); Alain Geiser, Murten (CH)

(73) Assignee: Comadur SA, Le Locle (CH)

( * ) Notice: Subject to any disclaimer, the term of this patent is extended or adjusted under 35 U.S.C. 154(b) by 691 days.

(21) Appl. No.: 16/597,142

(22) Filed: Oct. 9, 2019

(65) Prior Publication Data

US 2020/0121037 A1 Apr. 23, 2020

(30) Foreign Application Priority Data

Oct. 22, 2018 (EP) ..... 18201819

(51) Int. Cl.

| | |
|---|---|
| ***A44C 5/10*** | (2006.01) |
| ***A44C 27/00*** | (2006.01) |
| ***A44C 5/04*** | (2006.01) |
| ***A44C 5/24*** | (2006.01) |

(52) U.S. Cl.

CPC ..... *A44C 5/107* (2013.01); *A44C 5/04* (2013.01); *A44C 5/102* (2013.01); *A44C 5/105* (2013.01); *A44C 5/24* (2013.01)

(58) Field of Classification Search

CPC ..... A44C 5/107; A44C 5/10; A44C 5/102; A44C 5/105; Y10T 29/49591; Y10T 29/4959; Y10T 29/49579

See application file for complete search history.

(56) References Cited

U.S. PATENT DOCUMENTS

| | | | |
|---|---|---|---|
| 1,405,851 | A | 1/1922 | Lewis |
| 2,055,541 | A | 9/1936 | Kestenman |

(Continued)

FOREIGN PATENT DOCUMENTS

| | | | |
|---|---|---|---|
| CH | 663 136 | A5 | 11/1987 |
| CN | 2896971 | Y | 5/2007 |

(Continued)

OTHER PUBLICATIONS

English translation of the Combined Taiwanese Office Action and Search Report dated Aug. 10, 2020 in Patent Application No. 108135495, 16 pages.

(Continued)

*Primary Examiner* — Jack W Lavinder

(74) *Attorney, Agent, or Firm* — Oblon, McClelland, Maier & Neustadt, L.L.P.

(57) ABSTRACT

A bracelet having articulated links, including an articulation between a first link and a second link including a tongue that pivots in an opening between side flanges of this first link together forming a double clevis fitting, wherein, in the articulation, the first link or respectively the second link includes at least one external trunnion or respectively at least one internal trunnion arranged to pivot in an internal half-bearing of the second link, or respectively in an external half-bearing of the first link, the second link or respectively the first link includes at least an upper part and a lower part arranged to enclose and conceal therebetween each external trunnion or respectively each internal trunnion.

18 Claims, 3 Drawing Sheets

(56) References Cited

U.S. PATENT DOCUMENTS

| | | | | |
|---|---|---|---|---|
| 2,806,363 | A * | 9/1957 | Manne | A44C 9/02 63/5.2 |
| 3,948,040 | A * | 4/1976 | Tuppini | A44C 5/107 59/35.1 |
| 4,638,627 | A | 1/1987 | Wullsehleger et al. | |
| 5,233,574 | A * | 8/1993 | Walder | G04B 37/1486 368/294 |
| 6,237,319 | B1 * | 5/2001 | Amundsen | A44C 5/105 59/80 |
| 6,598,382 | B1 * | 7/2003 | Yoo | A44C 5/102 63/4 |
| 8,567,172 | B2 * | 10/2013 | Asami | A44C 5/0053 63/7 |
| 9,066,563 | B2 * | 6/2015 | Chan | G04B 37/16 |

FOREIGN PATENT DOCUMENTS

| | | | |
|---|---|---|---|
| CN | 207411640 | U | 5/2018 |
| CN | 108201202 | A | 6/2018 |
| CN | 207927931 | U | 10/2018 |
| EP | 0 243 315 | A1 | 10/1987 |
| EP | 0 243 315 | B1 | 1/1990 |
| EP | 3 643 195 | A1 | 4/2020 |
| JP | 55-57314 | U | 4/1980 |
| JP | 56-22007 | U | 2/1981 |
| JP | 60-117709 | U | 8/1985 |
| JP | 60-261405 | A | 12/1985 |
| JP | 3149703 | U | 4/2009 |
| JP | 2015-29806 | A | 2/2015 |
| JP | 6233685 | B2 | 11/2017 |

OTHER PUBLICATIONS

Combined Taiwanese Office Action and Search Report dated Aug. 24, 2021,filed on Sep. 9, 2021 in corresponding Taiwanese Patent Application No. 108135495 (English Translation only), 15 pages.

Combined Taiwanese Office Action and Search Report dated Aug. 24, 2021 in corresponding Taiwanese Patent Application No. 108135495 (with English Translation of Category of Cited Documents), 10 pages.

Japanese Office Action dated Oct. 27, 2020 in Japanese Patent Application No. 2019-189141 (submitting English translation only), 5 pages.

Korean Office Action dated Dec. 15, 2020 in Korean Patent Application No. 10-2019-0127825 (with English translation), 11 pages.

Taiwanese Office Action dated Dec. 15, 2020 in Taiwanese Patent Application No. 108135495 (submitting English translation only), 7 pages.

Combined Chinese Office Action and Search report dated Mar. 3, 2021 in Patent Application No. 201911000494.2 (with English translation and Wnglish translation of Catefory of Cited Documents), 13 pages.

European Seach Report dated Apr. 23, 2019 in European Application 18201819.2, filed on Oct. 22, 2018 (with English Translation of Categories of Cited Documents).

* cited by examiner

ARTICULATED BRACELET WITH HIDDEN ARTICULATIONS

CROSS-REFERENCE TO RELATED APPLICATION

This application claims priority to European Patent Application No. 18201819.2 filed on Oct. 22, 2018, the entire disclosure of which is hereby incorporated herein by reference.

FIELD OF THE INVENTION

The invention concerns an articulated link bracelet, comprising at least a first link and a second link, and at least one articulation between a said first link and a said second link which comprises a tongue that is arranged to pivot in an opening between side flanges of said first link together forming a double clevis fitting.

The invention also concerns a watch including a bracelet of this type.

The invention also concerns a piece of jewellery including a bracelet of this type.

The invention also concerns a method of assembling a bracelet of this type.

The invention concerns the fields of horology and jewellery, and more specifically articulated bracelets for wearing a watch or a jewel.

BACKGROUND OF THE INVENTION

Articulated bracelets for watches or jewellery conventionally comprise pins inserted through the side which remain visible after assembly thereof by press fit and/or adhesive bonding. Often, their large diameter makes such pins unsightly, and any reduction in their dimensions makes them difficult to assemble and disassemble. Further, the housings for these pins form areas where dust and grease accumulate, which is difficult to remove other than by ultrasonic cleaning.

European Patent Application No. EP0243315A1 in the name of CHATELAIN discloses an articulated link bracelet, in particular for watches, wherein the links are articulated on elements made of extremely hard material, in particular these extremely hard elements are rubies. The articulation includes an arbor capable of rotating in the extremely hard elements integral with a first link; the arbor is integral with a second link adjacent to the first and includes axial positioning slots cooperating with protruding portions in the second link. This arbor ends on each side in a pivot rotating freely in the extremely hard elements. The links are, in particular, in two parts vertically, these parts being welded to each other once the arbor is set in place with the extremely hard elements.

Japanese Patent Document No. JPS55 57314U discloses an articulated bracelet including links each formed of two complementary upper and lower half-links, enclosing articulation arbors.

Japanese Patent Document No. JP2015 029806A in the name of CASIO COMPUTER discloses an articulated band designed to allow a user to choose freely and to combine a quality of material and a colour of a piece of band or link.

U.S. Pat. No. 1,405,851A in the name of LEWIS discloses a bracelet chain with removable links comprising bendable arms to hold them together.

SUMMARY OF THE INVENTION

The invention proposes to produce assembled bracelets, consisting of functional and/or decorative components, made of various and varied materials, without any assembly components, such as pins, screws or the like, being visible and evident on the side of the bracelet, or any insertion hole, such as a bore closed after insertion of the articulation element, or any arrangement specific to this articulation.

To this end, the invention concerns an articulated link bracelet according to claim 1.

The invention also concerns a watch including a bracelet of this type.

The invention also concerns a piece of jewellery including a bracelet of this type.

The invention also concerns a method of assembling a bracelet of this type.

BRIEF DESCRIPTION OF THE DRAWINGS

Other features and advantages of the invention will appear upon reading the following detailed description, with reference to the annexed drawings, in which:

FIG. 6 represents a schematic perspective view of a bracelet comprising such an alternate arrangement of external H-shaped links and internal links, with an intermediate clasp, and end links for attachment thereof to a watch case or similar.

DETAILED DESCRIPTION OF PREFERRED EMBODIMENTS

Figure 1:
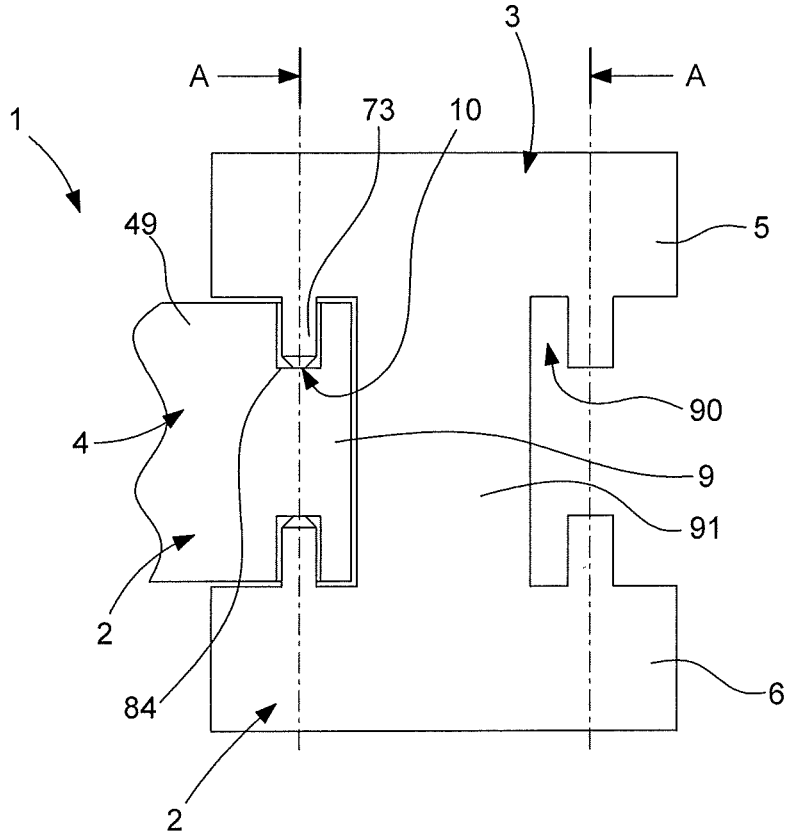
FIG. 1 represents a schematic plan view of a section of bracelet according to the invention, comprising an external link in the form of a capital H, with two double clevis fittings, each comprising two whole trunnions referred to as 'external trunnions', facing the middle of the link and opposite one another, and each cooperating with a half-bearing comprised in an end tongue of a lower part of an internal link, which is of different shape from the H-shaped link and inserted into the double clevis fitting carrying these two external trunnions. on the left part of the Figure; this lower part of an internal link extends here over a half-thickness of the bracelet and is delimited by a plane passing through an axis of articulation along which are aligned the axes of its two half-bearings.

It is an object of the invention to produce bracelets, which have no articulation able to be seen at least on the traditional visible surfaces, i.e. the upper surface and the side edge surfaces. More particularly, the invention also makes it possible for the lower surface, which is intended to be in contact with the user's skin or clothing, to be devoid of any attachment or articulation element.

The invention is more particularly explained using conventional articulations, each combining, about an axis of articulation, a pivot rotatable in a bearing, or a bearing rotatable about a pivot.

The principle of the invention consists in making certain links in several parts, particularly two upper and lower parts, extending substantially on either side of a plane passing through the axis of articulation. More generally, such a two-part link defines at least one chamber, for example a bearing, in each case to enclose a male part of a counter-link, for example a trunnion.

When this link is an intermediate link comprising an articulation at each end, each upper or lower part extends substantially on either side of a plane passing through the two axes of articulation of this link. When this link is an end link having only one articulation at only one end, each upper or lower part extends substantially on either side of a plane passing through the axis of articulation of this link and the joining surface between the upper part and the lower part. It is understood that the link can be curved, in which case each upper or lower part substantially follows the curve of the link, in which case the joining surface between the upper part and the lower part is not necessarily plane.

The Figures illustrate a particular non-limiting variant, wherein the pivots are cylindrical trunnions, and wherein the bearings are also cylindrical. Naturally, many other arrangements are possible, particularly cooperation of a cylindrical trunnion with a bearing formed of two half-bearings each comprising a V-shaped support, or in a similar but inverted manner, a regular polygonal trunnion geometrically inscribed in a cylinder and cooperating with a cylindrical bearing formed of two half-bearings of cylindrical profile. These examples are not limiting, and the simplest machining operation may be preferred, especially for certain links made of materials that are difficult to machine.

The term 'trunnion' and the term 'half-bearings' used in the following description are thus not restricted to cylindrical geometries. It will be noted in this regard that conical embodiments could also be made, provided that the direction of tapering at each end of each articulation is opposite.

The principle of links in several parts, particularly two upper and lower parts, is also applicable to other less common types of articulation, for example an articulation extending substantially along the length of the bracelet and comprising a ball at the end of a pin, and movable inside a spherical housing, or otherwise.

Thus, the invention concerns a bracelet 1 having articulated links 2. This bracelet 1 includes at least a first link 3 and a second link 4, and at least one articulation 10 between this first link 3 and this second link 4. This second link 4 includes a tongue 9, which is arranged to pivot in an opening 90 between side flanges 5 and 6 of first link 3, which together form a double clevis fitting.

According to the invention, on at least one articulation 10, first link 3, or respectively second link 4, comprises at least one external trunnion 73, or respectively at least one internal trunnion 74, which is arranged to pivot in at least one internal half-bearing 84 comprised in second link 4, or respectively in at least one external half-bearing 83 comprised in first link 3. And second link 4, or respectively first link 3 comprises at least an upper part 48, 38, and a lower part 49, 39, which are arranged to enclose and hide between them each external trunnion 73, or respectively each internal trunnion 74.

In a particular embodiment of this bracelet 1, upper part 48, 38 and lower part 49, 39 are irreversibly assembled to each other and cannot be disassembled, about each external trunnion 73 or respectively each internal trunnion 74. This variant makes it possible to free the lower surface of the bracelet from any visible attachment element.

In another particular embodiment of this bracelet 1, not illustrated in the Figures, upper part 48, 38, and lower part 49, 39 are detachably assembled to each other, about each external trunnion 73, or respectively each internal trunnion 74. This variant, may, for example, comprise a screw accessible from the lower surface of the bracelet, bearing on a lower part 49, 39, and engaged with a blind internal thread comprised in upper part 48, 38 or any other type of similar attachment means.

In a particular embodiment of the invention, in order to reduce the number of components and machining operations, on at least one articulation 10, an external trunnion 73, or respectively at least one internal trunnion 74, is in one piece with first link 3 or respectively second link 4. Likewise, in a variant, an internal half-bearing 84, or respectively an external half-bearing 83, is in one piece with second link 4 or respectively first link 3.

In another embodiment, on at least one articulation 10, an external trunnion 73, or respectively an internal trunnion 74, is placed in a housing 740 comprised in first link 3, or respectively second link 4. Likewise, in a variant, an internal half-bearing 84, or respectively an external half-bearing 83, is placed in second link 4, or respectively in first link 3.

In a particular embodiment, on at least one articulation 10, an external trunnion 73 or respectively at least one internal trunnion 74, is a cross-trunnion and joins between side flanges 5, 6 to one another.

FIG. 1 shows a section of bracelet 1 according to the invention, comprising a first link 3 which is an external capital H-shaped link, with two double clevis fittings, each comprising two whole trunnions 73, referred to as 'external trunnions', said trunnions having a surface of revolution here, facing the middle of the link and opposite one another, and each cooperating with a half-bearing 84 comprised in an end tongue 9 of a lower part 49 of a second link 4 which is an internal link, which is of different shape from the H-shaped link and inserted into the double clevis fitting carrying these two external trunnions, on the left part of the Figure; this lower part 49 of second internal link 4 extends here over a half-thickness of the bracelet, and is delimited by a plane passing through an axis of articulation A along which are aligned the axes of its two half-bearings.

Figure 2:
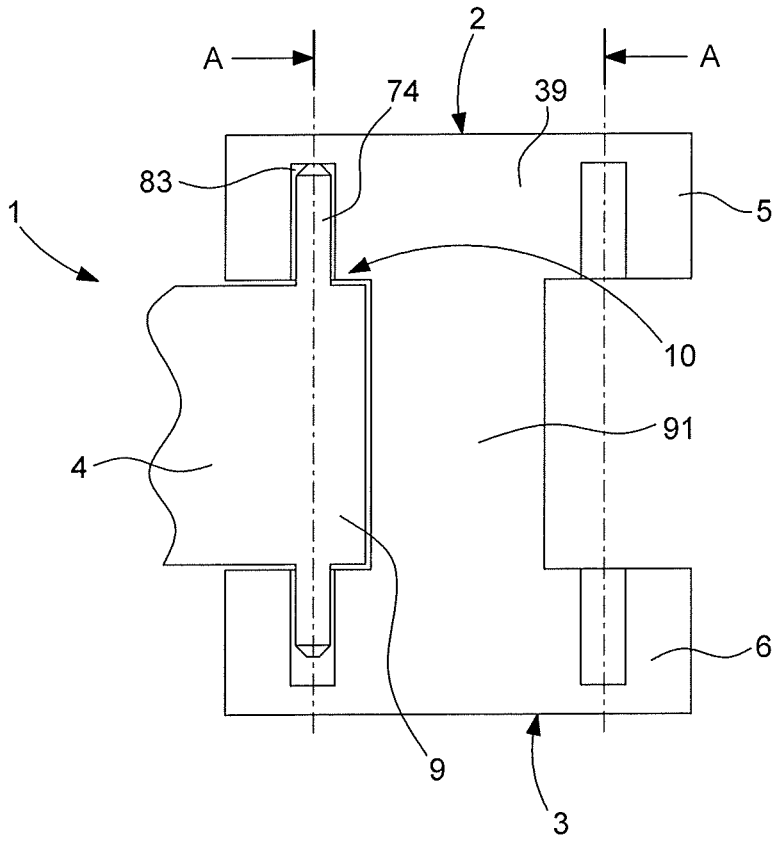
FIG. 2 represents, in a similar manner to FIG. 1, a lower part of another capital H-shaped link with two double clevis fittings, in the reverse configuration to that of FIG. 1: each clevis fitting includes a half-bearing, arranged to receive a whole trunnion, referred to as an 'internal trunnion', comprised in an end tongue of another internal link, which is of different shape from the H-shaped link, and inserted into the double clevis fitting carrying these two half-bearings, in the left part of the Figure; this time it is the lower part of the H-shaped link which extends over a half-thickness of the bracelet, and is delimited by a plane passing through an axis of articulation along which are aligned the axes of its two half-bearings.

FIG. 2 shows a reverse configuration to that of FIG. 1, with a lower part 39 of another H-shaped first link 3 with two clevis fittings: each clevis fitting comprises a half-bearing 83, arranged to receive a whole trunnion 74, referred to as an 'internal trunnion', and which has a surface of revolution here comprised in an end tongue 9 of another second internal link 4, which is of different shape from the H-shaped link, and inserted into the double clevis fitting carrying these two half-bearings, in the left part of the Figure. This time it is the lower part 39 of the H-shaped link which extends over a half-thickness of the bracelet and is delimited by a plane passing through an axis of articulation along which are aligned the axes of its two half-bearings.

Figure 3:
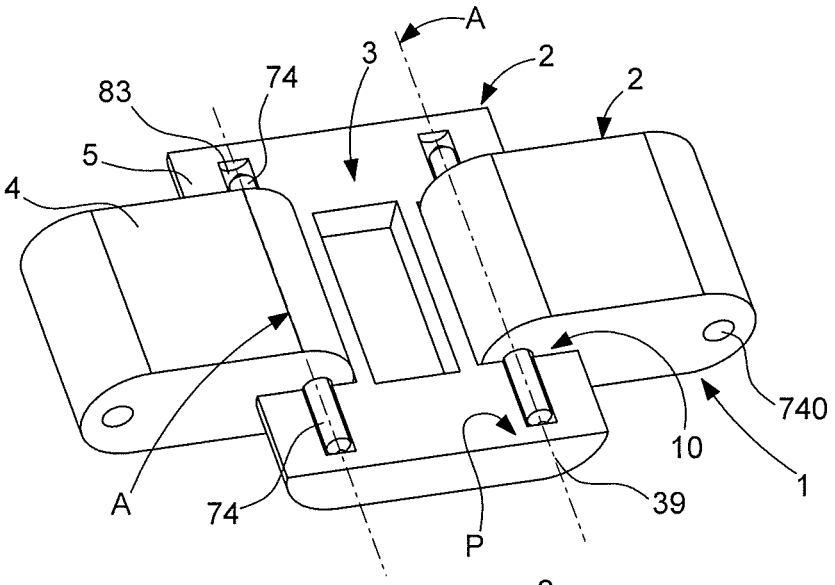
FIG. 3 represents a schematic perspective view of a bracelet section according to the configuration of FIG. 2, wherein two internal links, non-exclusively here of the thickness of the bracelet, comprise whole trunnions which are housed inside the respective half-bearings of the lower part of an H-shaped link, which includes an inner lightening chamber.

FIG. 3 shows this configuration of FIG. 2, wherein two second internal links 4, non-exclusively here of the thickness of the bracelet, comprise whole trunnions 74 which are housed inside the respective half-bearings 83 of the lower part 39 of a first H-shaped link 3, which includes here a blind, inner, lightening chamber, or which could include an opening, or an added component, particularly a set element such as a gemstone, a cameo, an added decoration, or otherwise.

Figure 4:
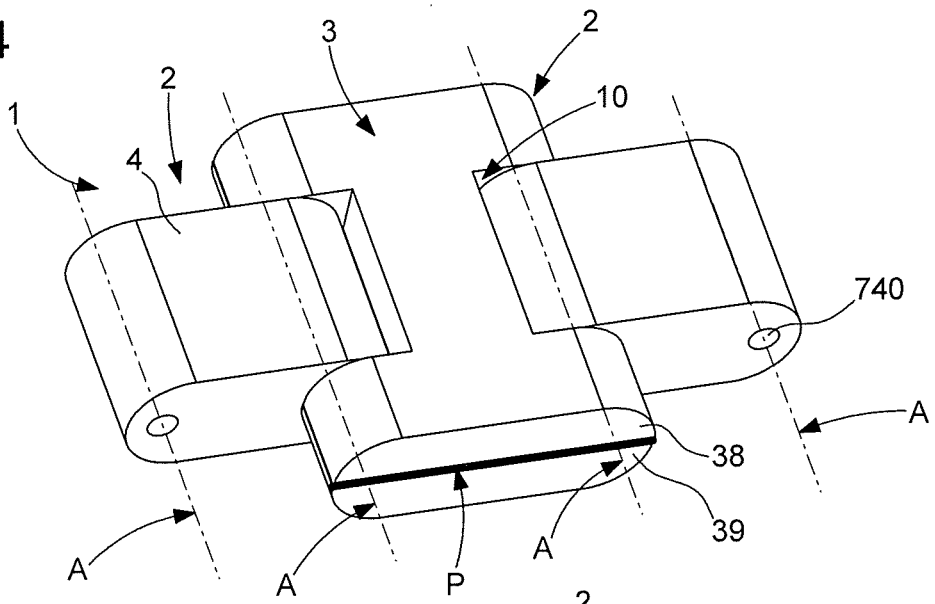
FIG. 4 represents, in a similar manner to FIG. 3, the same bracelet section which is completed by an upper part of the H-shaped link, comprising half-bearings, and disposed on the lower part of this H-shaped link, and secured thereto, by adhesive bonding or suchlike, or by attachment from a lower surface that is not visible when the bracelet is worn by a user, in order to enclose the trunnions of the two internal links in an invisible manner.

FIG. 4 represents the same bracelet section, which is closed, once completed by an upper part 38 of a first H-shaped link 3, also comprising half-bearings, and which is disposed on lower part 39 of this H-shaped link, and secured thereto, by adhesive bonding or suchlike, or by attachment from a lower surface that is not visible when the bracelet is worn by a user, in order to enclose the trunnions of the two internal links in an invisible manner. This FIG. 4 shows the joint plane P between upper part 38 and lower part 39 of first link 3. This non-limiting variant also shows a housing 740 of second link 4 to the right of the Figure, arranged to receive an added pin to form a trunnion 74.

Figure 5:
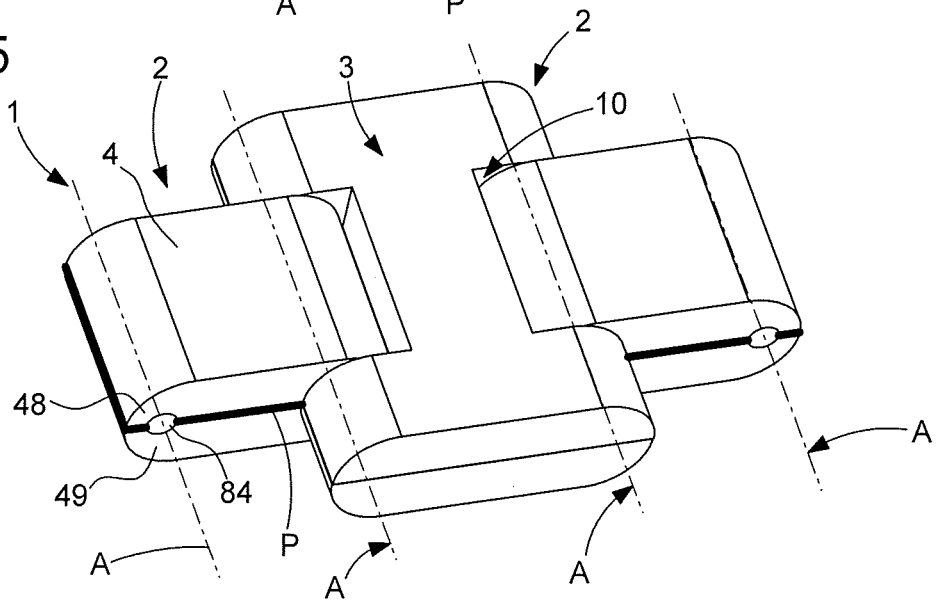
FIG. 5 represents, in a similar manner to FIG. 4, another bracelet section, which corresponds to the variant of FIG. 1, and which includes an H-shaped link, non-exclusively here of the thickness of the bracelet, provided with trunnions, which are enclosed in an invisible manner between the upper and lower half-bearings of the internal links.
Figure 6:
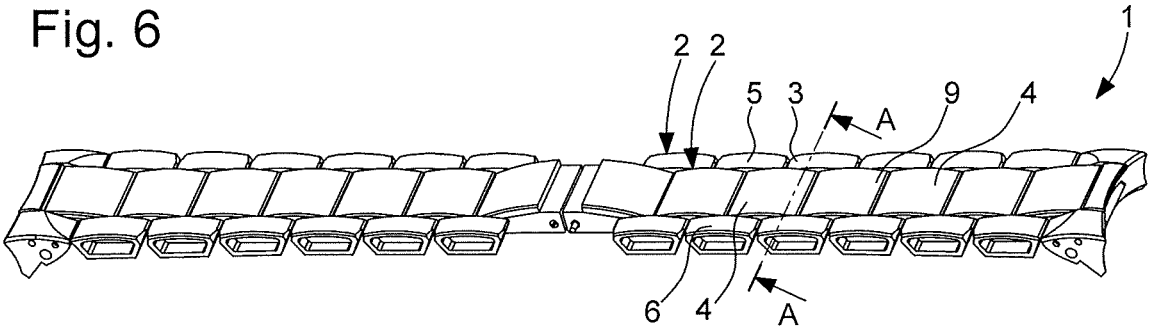

FIG. 5 shows another bracelet section, which corresponds to the variant of FIG. 1, and which includes a first H-shaped link 3 non-exclusively here of the thickness of the bracelet, provided with trunnions, which are invisibly enclosed between the upper and lower half-bearings of the upper and lower parts 48 and 49 of second internal links 4, and whose joint plane P is visible in the Figure, and the bearing formed by two half-bearings 84, to the left of the Figure.

Figure 9:
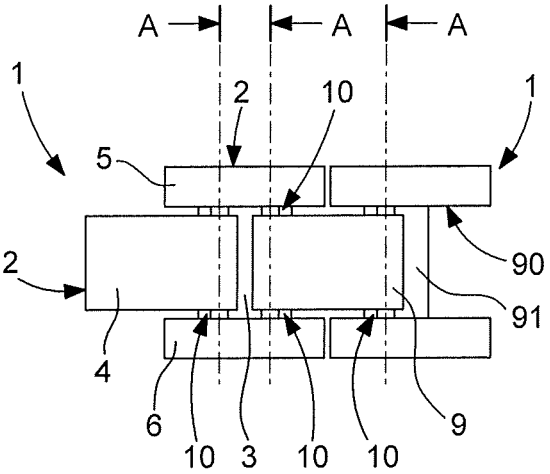
FIG. 9 represents a schematic plan view of a bracelet section with another external link variant with two double clevis fittings, comprising a transverse link joining its two side flanges, and comprising a connecting crosspiece cooperating with the upper and lower half-bearings of the upper and lower parts of intermediate internal links, which are arranged to be placed in superposition on the crosspiece or in the extension thereof.

In a particular embodiment visible in FIG. 9, first link 3 is an external H-shaped link, which includes a crosspiece 91 joining the side flanges 5 and 6, and second link 4 is an internal link, which is arranged to be placed in superposition on crosspiece 91, or in the extension of crosspiece 91. This first link 3 includes here a single connecting crosspiece replacing the two trunnions of the other variants and cooperating with the upper and lower half-bearings of second internal link 4.

Figure 10:
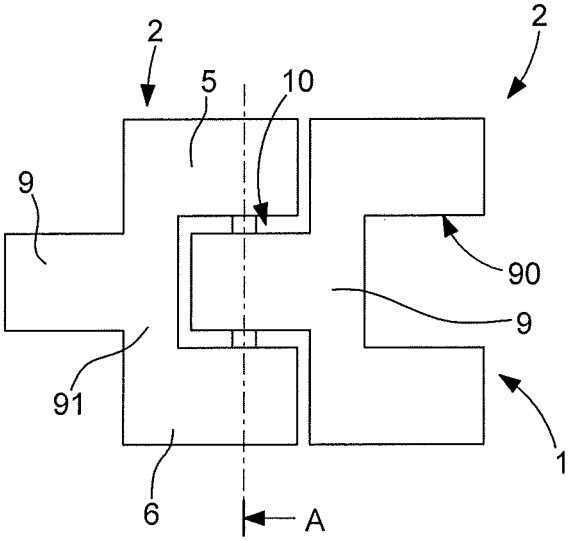
FIG. 10 represents a schematic plan view of a bracelet section with yet another link variant, all the links being Y-shaped and made in two upper and lower parts.

In a particular embodiment seen in FIG. 10, first link 3 and second link 4 are identical and are Y-shaped. More particularly, all the links are Y-shaped and made in two upper and lower parts.

In a particular embodiment, at least one upper part 48, 38 and/or one lower part 49, 39, is made of ceramic.

More particularly, all the upper parts 48, 38 are made of ceramic.

More particularly, all the lower parts 49, 39 are made of ceramic.

More particularly, all the upper parts 48, 38 and all the lower parts 49, 39 are made of ceramic.

Figure 7:
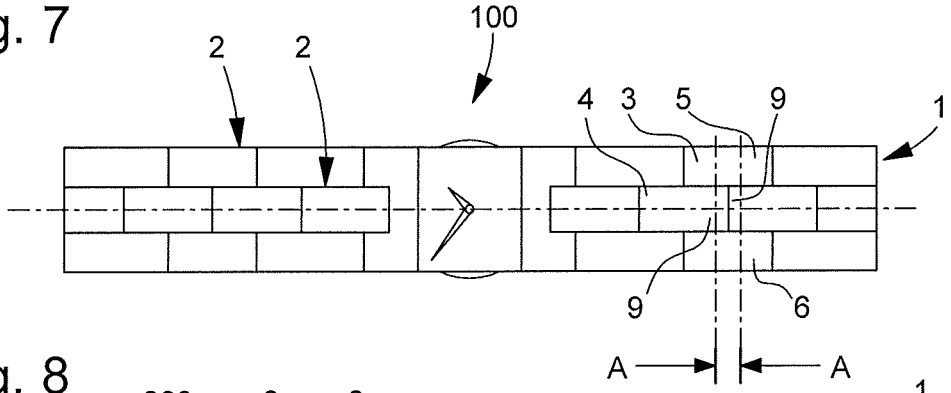
FIG. 7 represents a partial, schematic plan view of a watch provided with such a bracelet.

The invention also concerns a watch 100 including such a bracelet 1, seen in FIG. 7.

Figure 8:
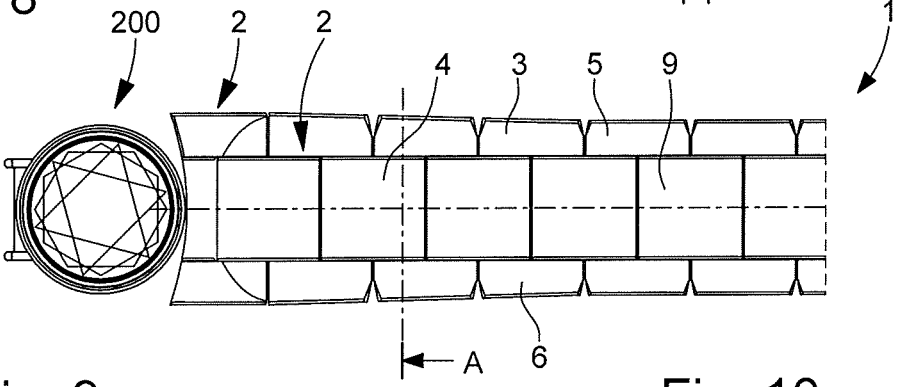
FIG. 8 represents a partial, schematic plan view of a jewel provided with such a bracelet.

The invention also concerns a piece of jewellery 200 including such a bracelet 1, seen in FIG. 8.

The invention further concerns a method of assembling an articulated bracelet, wherein;

there is provided a lower part of a two-part female link comprising at least one half-bearing defining an axis of articulation;

there is placed on this lower part another male link comprising at least one trunnion capable of cooperating in a rotary bearing arrangement with the half-bearing, and which is inserted into the half-bearing;

there is provided an upper part of the same two-part link, complementary to the lower part, and comprising at least one half-bearing defining an axis of articulation and arranged to cooperate in a rotary bearing arrangement with the trunnion;

each trunnion of the male link is enclosed, at least along the axis of articulation, between the lower part and the upper part;

the lower part and the upper part are secured to each other;

this operation is repeated for each articulated joint of this bracelet.

More particularly, this lower part and upper part are irreversibly and permanently joined to each other.

In short, the invention produces an articulated bracelet with invisible articulations in a simple manner.

In a particular embodiment, a two-part link, particularly a central link, encloses the male bearing members, such as pins, or trunnions or otherwise.

The two parts can be secured by adhesive bonding, press fit, induction welding, induction soldering, or otherwise.

The invention is particularly suited for making bracelets made of materials that are difficult to machine, such as ceramic or suchlike.

The advantage of the invention is the absence of any visible pins, or any visible articulation machining. This makes it possible, in particular, to use the edges of the bracelet for decorations.

The invention claimed is:

1. A bracelet having articulated links, comprising:

at least a first link and a second link, and at least one articulation between said first link and said second link which comprises a tongue that is arranged to pivot about an axis of articulating in an opening between side flanges of said first link together forming a double clevis fitting, wherein, in at least one said articulation, said second link includes at least one internal trunnion extending outwardly from a body of the second link such that a distal end of the at least one internal trunnion is a widest part of the second link in a direction parallel to the axis of articulation, the at least one internal trunnion being arranged to pivot in at least one external half-bearing positioned on an internal face of the side flanges of said first link, wherein said first link is a two-part link that comprises at least an upper part and a lower part that are separate and then joined to enclose and conceal therebetween each said internal trunnion, and wherein, in at least one said articulation, at least one internal trunnion is in one piece with said second link.

2. The bracelet according to claim 1, wherein said upper part and said lower part are irreversibly assembled to each other, about each said internal trunnion.

3. A watch comprising a bracelet according to claim 2.

4. The bracelet according to claim 1, wherein, in at least one articulation, said at least one internal trunnion is a cross-trunnion and joins said side flanges to one another.

5. The bracelet according to claim 1, wherein said first link is an external H-shaped link comprising a crosspiece joining said side flanges, and wherein said second link is an internal link, arranged to be placed in superposition on said crosspiece, or in the extension of said crosspiece.

6. The bracelet according to claim 1, wherein said first link and said second link are identical and are Y-shaped.

7. The bracelet according to claim 1, wherein at least one said upper part and/or one said lower part is made of ceramic.

8. The bracelet according to claim 7, wherein all of said upper parts are made of ceramic.

9. The bracelet according to claim 7, wherein all of said lower parts are made of ceramic.

10. The bracelet according to claim 7, wherein all of said upper parts and all of said lower parts are made of ceramic.

11. The bracelet according to claim 1, wherein the upper part and the lower part are joined along a planar joining surface.

12. The bracelet according to claim 11, wherein the planar joining surface passes through the axis of articulation.

13. The bracelet according to claim 1, wherein a width of the first link in the direction parallel to the axis of articulation is greater than a width of the second link.

14. A method of assembling an articulated bracelet, comprising:

providing a lower part of a two-part female link comprising at least one half-bearing defining an axis of articulation;

placing on said lower part a male link comprising a body and at least one trunnion extending from the body and being capable of cooperating in a rotary bearing arrangement with the at least one half-bearing, and which is inserted into the at least one half-bearing, a distal end of the at least one trunnion being a widest part of the body in a direction parallel to the axis of articulation; and after the placing on said lower part, joining an upper part of the two-part female link, to the lower part, and comprising at least one half-bearing defining an axis of articulation and arranged to cooperate in a rotary bearing arrangement with the trunnion, wherein each trunnion of the male link is enclosed, at least along the axis of articulation, between the lower part and the upper part, wherein the lower part and the upper part are two separate parts that are secured to each other, and wherein said providing, placing, and attaching are repeated for each articulated joint of the articulated bracelet.

15. The method according to claim 14, wherein said lower part and said upper part are irreversibly joined to each other.

16. The method according to claim 14, wherein the upper part and the lower part are joined along a planar joining surface.

17. The method according to claim 16, wherein the planar joining surface passes through the axis of articulation.

18. The method according to claim 14, wherein a width of the first link in the direction parallel to the axis of articulation is greater than a width of the second link.

* * * * *